United States Patent [19]

Glenn

[11] 4,204,625

[45] May 27, 1980

[54] TACK STRIP NAILER

[76] Inventor: Travis A. Glenn, c/o C. Cantrell, 3215 Ave. G, Dickinson, Tex. 77539

[21] Appl. No.: 916,664

[22] Filed: Jun. 19, 1978

Related U.S. Application Data

[63] Continuation of Ser. No. 750,263, Dec. 23, 1976, abandoned.

[51] Int. Cl.[2] ..... B25C 1/02

[52] U.S. Cl. ..... 227/76; 227/110; 227/145; 227/147

[58] Field of Search ..... 227/63, 76, 110, 145, 227/147, 142; 145/46; 30/165, 188, 277, 367

[56] References Cited

U.S. PATENT DOCUMENTS

| | | | |
|---|---|---|---|
| 1,397,362 | 11/1921 | Clarke et al. | 30/277 |
| 2,425,494 | 8/1947 | Taylor | 227/147 |
| 2,430,532 | 11/1947 | Rayburn | 227/142 |
| 2,557,000 | 6/1951 | Holmes | 145/46 |
| 2,845,103 | 7/1958 | Sypher | 145/46 |
| 2,982,966 | 5/1961 | La Pointe et al. | 227/63 |
| 3,711,008 | 1/1973 | Clifford et al. | 227/147 |

*Primary Examiner*—John McQuade
*Attorney, Agent, or Firm*—C. Emmett Pugh & Associates

[57] ABSTRACT

An apparatus for installing a tack strip or the like providing a rigid frame having an adjustable guide which spaces the tack strip at a proper distance from a wall, baseboard, or other guide. An adjustable base on the apparatus varies the width of an open space in which a tack strip to be installed is positioned and located. The base gap width thus can be adjusted to position differing width tack strips as necessary. A central hammer equipped with an impact head is hit with a conventional hammer or the like, when the tack strip nailer is located above a spot in the tack strip where it is desirous to hammer a nail to secure the tack strip. The hammer can be equipped with a magnetic tip portion for holding and properly orienting nails to be installed. Additionally, the hammer is adjustable in its longitudinal position over the tack strip allowing the proper placement of the hammer to correspond with different tack strip widths. Normally, the hammer must be adjusted to place it vertically over the nails located in the center of the tack strip. The device is equipped with a pair of track strip cutters, each provided with an impact receptive head which allows force to be applied to the cutter by a conventional hammer blow. The cutters are installed on opposite sides of the frame, thus allowing a cut to be made on either side of the frame. A curved claw is also attached and provided as an aid to the removal of nails as desired.

14 Claims, 2 Drawing Figures

TACK STRIP NAILER

This is a continuation of application Ser. No. 750,263 filed Dec. 23, 1976, entitled "Tack Strip Nailer", now abandoned.

BACKGROUND OF THE INVENTION

1. Field of the Invention

The present invention relates to the installation of carpet and tools utilized in the installation of carpet. More particularly, the present invention relates to a device for the installation of tack strips associated with the installation of carpeting.

2. General Background and Prior Art

In the installation of wall to wall carpet, or the like, the side portions of the carpet are anchored to the floor upon which they are installed in various ways. One method of adhering the carpet to the floor upon which it is to be mounted is the utilization of a "tack strip". "Tack strips" are available in a variety of sizes and material types. A tack strip is generally an elongated length of material which can be placed along the edge portion of the carpet and then anchored to the floor by means of nails or the like to thereby hold the carpet and prevent its removal or prevent the danger of an individual catching his foot on the edge of the carpet when walking across it.

"Tack strips" are usually installed adjacent walls or wall finishing elements. The distance at which the carpet will be installed from the walls and thus the location of the tack strip must be properly dimensioned and marked. However, precise uniform spacing of the strips from and along walls and wall finishing elements can be difficult using merely conventional type tools. Also the driving of a tacking nail, is commonly attended by the marring of adjacent walls and wall finishing surfaces.

Several devices have been patented which have attempted to solve the problem of properly installing "tack strips". The following tables provides a listing of some prior art devices which have obtained U.S. patents.

PRIOR ART PATENTS

| U.S. PAT. NO. | INVENTOR(S) | ISSUE DATE |
|---|---|---|
| 612,833 | L. W. Dexter | Oct. 25, 1898 |
| 1,180,405 | J. W. Lovering | Apr. 25, 1916 |
| 1,412,507 | C. J. Carter | Apr. 11. 1922 |
| 1,480,479 | P. Truskowski | Jan. 8, 1924 |
| 2,845,103 | E. K. Sypher | July 29, 1958 |
| 3,086,530 | W. Groom | Apr. 23, 1963 |
| 3,176,399 | A. J. Marino et al | Apr. 6, 1965 |
| 3,381,730 | R. E. Omholt | May 7, 1968 |

GENERAL DISCUSSION OF THE PRESENT INVENTION

The apparatus of the present invention is designed to properly space a "tack strip" of any width from an adjacent wall to which the "tack strip" is proximately attached. The device is designed to eliminate baseboard marking, marring and battering. Adjustments are provided on the device to work with and properly position any width tack strip to be installed. The device additionally is provided with "tack strip" cutters which are operated by the impact of a conventional hammer. A hammer is also utilized to set each nail individually as needed into the "tack strip" The "tack strip" nailing hammer can be magnetic so as to suspend the nail in the proper position before it is secured by the impact of a hammer blow which drives the nail into the "tack strip" and the floor to which it is installed. The hammer is adjustable so as to be properly placed above the strip where nails will be installed.

Additional convenience tools can be attached to the preferred embodiment of the present invention, such as a small crowbar for removing unwanted materials and portions of the "tack strip" or nails as desired. Also, a removable metal nail pouch can be suspended, if desired, from the "tack strip" nailer apparatus or a nail magazine used therewith.

The "tack strip" installing apparatus of the present invention is comprised generally of a rigid frame having an adjustable reciprocating hammer movably attached to the frame. The hammer is suspendedly mounted in the frame utilizing a heavy coil spring to hold the hammer in a spaced position above the "tack strip" surface. Guide means connected to the frame slideably position the frame and hammer above the "tack strip", so that actuation of the hammer by means of energy applied to the hammer will direct force into the nails sequentially mounted in the "tack strip" itself. The device is initially provided with a plurality of "tack strip" cutters which are pivotally mounted on the frame and provided with impact receptive heads for transferring force from, for example, a conventional hammer, to the "tack strip" itself.

A handle can be attached to the frame, the handle provided with a curved claw tip for removing nails or the strip itself as required or such a curved claw could be provided at the rear of the device.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

STRUCTURE

Figure 1:
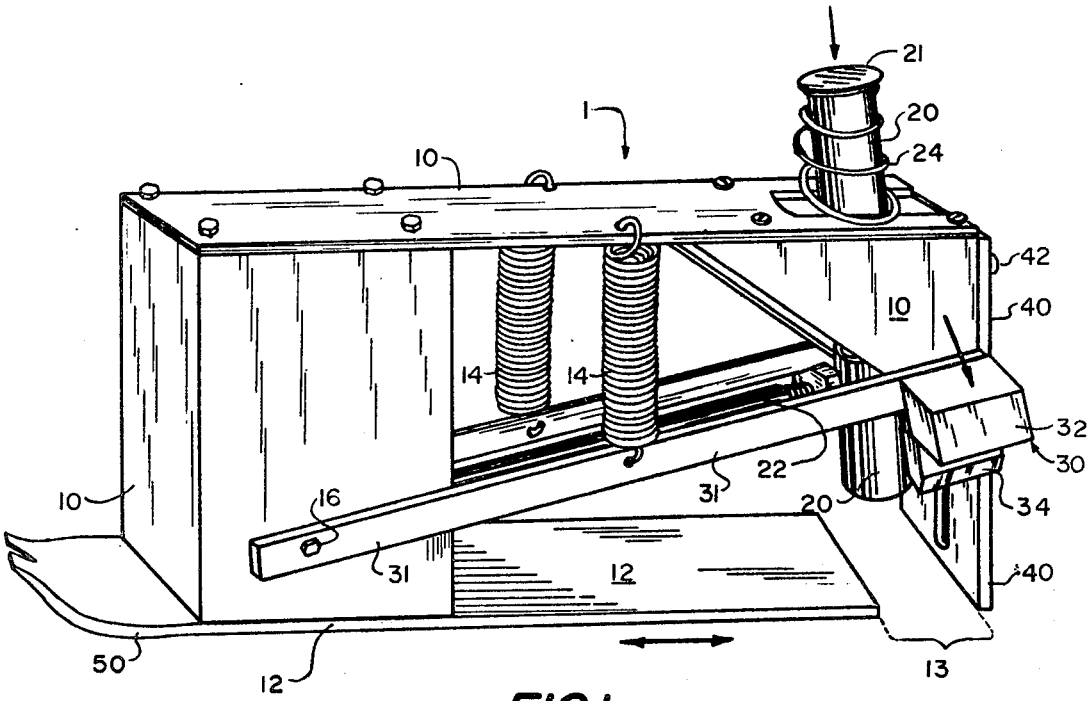
FIG. 1 is a perspective view of the preferred embodiment of the apparatus of the present invention.

As can best be seen in FIG. 1, the preferred embodiment of the tack strip nailer of the present invention, designated generally by the numberal 1, FIG. 1, is comprised of a rigid frame 10, a hammer 20 which is pivotally attached to rigid frame 10, and a plurality of cutters 30. The frame is provided with a wall spacer front portion 40 which can abut a surface adjacent to which a tack strip will be installed. The width of spacer determines the distance which the tack strip will be installed from the wall itself. Thickness of spacer 40 can be varied as desired and spacer 40 can be removed and other width spacers 40 installed as necessary utilizing mounting bolts 42.

The lower portion of frame 10 has adjustment plate 12 slideably mounted thereto. The slideable adjustment of adjustment plate 12 provides a gap 13 between plate 12 and wall spacer 40. Gap 13 is adjustably fixed to slideably receive the desired width tack strip therebetween. The end portion of adjustment plate 12 can be provided with curved claw 50 which can remove a misplaced tack strip, nails and the like.

Figure 2:
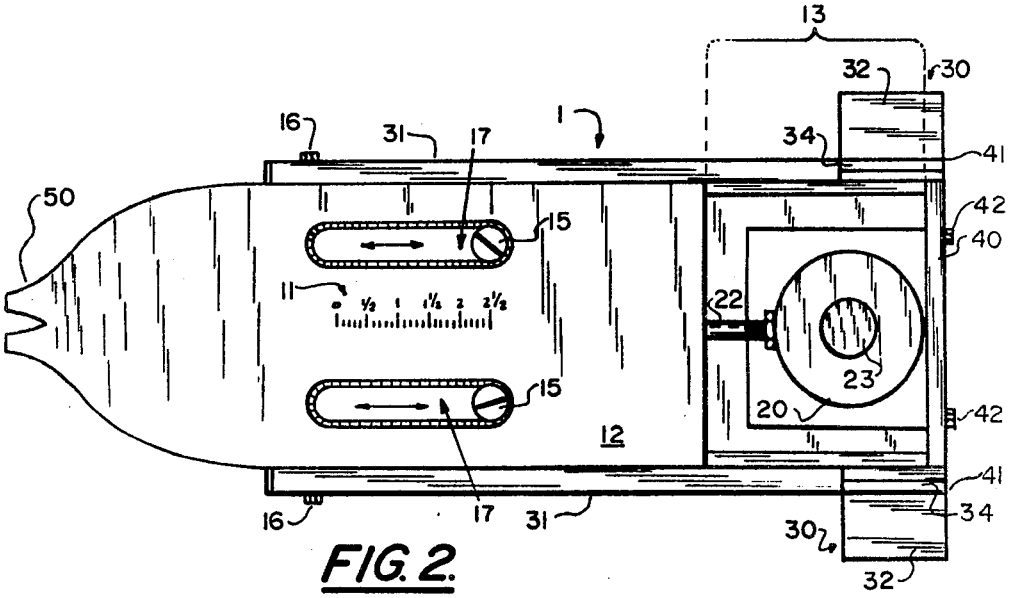
FIG. 2 is a bottom view of the tack strip nailer shown in FIG. 1.

Hammer 20 is pivotably mounted to frame 10 by means of hammer arm 22. Hammer 20 is for example, threadably mounted on arm 22, providing an adjustability of head 20 above gap 13 (See FIGS. 1 and 2). Hammer arm 22 has its pivotal attachment to frame 10 at pivot pin 16. Thus, hammer 20 travels through an arcuate path, the center of which is pivot pin 16. The upper portion of hammer 20 is provided with impact head 21 to which a force can be applied which is transmitted through hammer 20 to a nail and a tack strip placed within gap 13. In the preferred embodiment, force can be directed to hammer head 21 by means of a conventional tool such as a hammer or the like. Hammer 20 is suspended a distance above a tack strip, which can be placed in gap 13 so as to be installed as needed, by hammer spring 24. Hammer spring 24 holds hammer 20 suspendedly above the tack strip, but its resiliency is not so great as to overcome the application of force to hammer 20 necessary to drive nails as required into the tack strip. Hammer 20 is provided with magnetic center 23 which retains nails prior to nailing.

The apparatus of the present invention 1 is also provided with a pair of tack strip cutters 30 pivotally attached by means of cutter arms 31 to pivot pin 16. Thus, cutters 30 are similarly mounted to frame 10 as hammer 20. Cutters 30 are also held in a spaced suspended orientation above the tack strip by means of spring forces, namely by cutter springs 14. Springs 14 are likewise not so resilient as to prevent the travel of cutters 30 to tack strip (not shown) upon the application of force to cutters 30. Each cutter 30 is provided with an impact head 32 to which force can be applied in order to move cutter 30 downward toward the tack strip. The lower portion of cutter head 32 is provided with a blade 34 which will actually sever tack strip when force is applied to the head by conventional means such as a hammer or the like. The blade can be of a width sufficient to sever any tack strip which may be placed within gap 13 after the proper adjustment has been made to plate 12.

In the preferred embodiment, two cutters are provided on either side of frame 10. Thus, if the tack strip cutter 1 is moved in either direction down the tack strip, the cutter will always be able to make a desired cut on the "leading" side of the tack strip cutting device 1 of the present invention.

The device can be provided with a handle which would preferably have a curved claw type end, thus providing a means for the removal of nails or portions of the tack strip itself. Alternatively, as illustrated, a curved claw section 50 can be provided at the back of the device 1 as the terminal end of base plate 12. If desired, a removable nail pouch could be suspendedly attached to the handle if desired.

OPERATION

In operation, the tack strip cutter frame 10 is lifted and placed with the wall spacer 40 abutting a wall, baseboard, or the like adjacent to which a tack strip will be installed. Wall spacer 40 is preferably manufactured with a thickness corresponding to the distance which the tack strip will be spaced from the wall, for example, one-quarter inch. The adjusting plate 12 is then adjustably set to form a gap 13 between the wall spacer 40 and adjustment plate 12 corresponding to the width of the tack strip being installed. Guage marks 11 can be added to adjustment plate 12 and placed in such a postion as to correspond with the width of gap 13. Thus, the gap 13 can be set by aligning guage marks 11 as necessary. Then set screw 15 can be tightened in slot 17 to affix the width of gap 13.

Once the proper adjustments have been made to gap 13, the device is placed adjacent to the wall and over a tack strip which will be installed. The device is then moved along the wall with wall spacer 40 abutting the wall or baseboard thereof throughout the entire operation. The tack strip normally will have nails preinstalled, which nails will be hammered into the tack strip and the floor thereunder to which the strip will be attached. As the hammer 20 aligns with each nail to be installed, the device is halted and the hammer head 21 struck with a conventional hammer to thereby force the hammer 20 downward and strike the nail, thereby driving it into the tack strip and floor thereunder. The tack strip nailer is moved along the strip and stopped at each nail in this manner and the nail installed by striking hammer 20 at each nail. When the strip is completely installed, or when the device comes to a location where a cut is to be made, the edge portion 41 of wall spacer 40 is aligned on the strip at the spot to be cut. The blade 34 of cutter 30 severs the tack strip when the cutter impact head 32 is struck with a conventional hammer forcing blade 34 downwardly until it severs the tack strip with the force applied to the cutter impact head by means of a conventional hammer. Since cutters 30 are installed on either side of the frame 10, the tack strip can be severed while moving the device 1 in either direction and by striking the appropriate cutter as desired. Thus, an operator could handle the frame with his left hand and apply force to the cutter on his right using his right hand. A left handed operator could likewise move the frame 10 with his right hand and apply force to the left hand cutter using a hammer in his left hand.

Whenever either cutter 30 or hammer 20 is struck, springs are provided which will return the cutter 30 or hammer 20 as the case may be to its spaced position above the tack strip. Each cutter is provided with a cutter spring 14 which is attached at one point to frame 10 and at its opposite end point cutter arm 31. Likewise, hammer 20 is provided with a hammer spring 24 which is surroundably mounted on hammer 20 and is retained at the bottom portion by frame 10 and its upper portion by the flanged hammerhead 21. Thus, hammer 20 is returned to its upward spaced position due to the compressive force applied by hammer spring 24 thereto. However, cutters 30 are returned to their upward spaced position above the tack strip by means of tensile force applied by cutter springs 14.

Because many varying and different embodiments may be made within the scope of the inventive concept taught herin, and because many modifications may be made in the embodiments herein detailed in accordance with the descriptive requirements of the law, it should be understood that the details herein are to be interpreted as illustrative and not in a limiting sense.

What is claimed as invention is:

1. An apparatus for installing a tack strip, comprising:

a. a rigid frame for positioning the apparatus with respect to the tack strip to be installed;

b. hammer means for driving nails through the tack strip, said hammer means movable attached to said frame for impacting movement in a vertical direction, and located above the position of the tack strip to be installed;

c. cutting means movably mounted on said frame for severing the tack strip, said cutting means comprising at least one elongated arm movably attached at one of its end portions to said frame, said arm being provided with a force receptive impact head, said impact head providing a surface for receiving an applied force capable of severing the tack strip, and said impact head having a cutting blade attached thereto.

2. The apparatus of claim 1, wherein there is provided on said frame at least two of said cutting means, one on either side of said hammer means to allow for both right hand and left hand usage as desired.

3. The apparatus of claim 1, wherein said arm is provided with spring means for urging said blade into a spaced elevated position above the tack strip to be installed.

4. An apparatus for installing a tack strip comprising:

a. a supporting frame, said frame provided with a tack strip positioning base portion for positioning the tack strip;

b. hammer means vertically movably mounted on said frame for applying hammered force to the tack strip, the placement of said tack strip within said base portion generally orienting said hammer means above the tack strip;

c. longitudinal adjustment means associated with said hammer means for adjustably changing the relative position of said hammer means longitudinally with respect to said frame and hence with respect to the center line of the tack strip; and d. guide means associated with said tack strip positioning base portion of said frame for allowing said track strip positioning base portion to be moved with guidance for controllably adjusting the width of said base portion to work with different width tack strips.

5. The apparatus of claim 4, further comprising curved claw means on said frame for removing a tack strip from an installed position.

6. The apparatus of claim 4, further comprising cutting means on said frame for severing a tack strip.

7. An apparatus for installing tack strips comprising:

a. a supporting frame, said frame providing a tack strip positioning base portion; said base portion positioning the tack strip is a desired position to be installed;

b. hammer means movably mounted on said frame for applying force to said tack strip, said hammer means oriented above said tack strip positioning base portion, operation of said hammer means applying a hammered force to said tack strip when said tack strip is positioned within said base portion; and c. guide means associated with said tack strip positioning base portion for allowing said track strip positioning base portion to be moved with guidance for controllably adjusting the width of said base portion to work with different width tack strips.

8. The apparatus of claim 7 wherein said hammer means is provided with holding means for holding a nail above the tack strip to be installed, before the hammer means is struck with force sufficient to drive the nail into the tack strip.

9. The apparatus of claim 8 wherein said holding means is a magnetic element located at the lower portion of said hammer means.

10. The apparatus of claim 7 wherein said hammer means is provided with spring means for supporting said hammer means in a spaced elevated position above the tack strip to be installed.

11. The apparatus of claim 7, wherein said guide means comprises an adjustable plate slidably attached to the bottom portion of said frame, said plate providing a tack strip engaging face which is capable of abutting one edge portion of the tack strip to be installed, and said frame is provided with spacing means for spacing said frame from a wall adjacent to which the tack strip will be installed, said spacing means having a tack strip engaging face in spaced, parallel relationship with the tack strip engaging face of said sliding plate, the tack strip being locatable between said adjustable plate and said spacing means.

12. The apparatus of claim 11, wherein said spacing means is a substantially vertical plate attached to the end portion of said frame nearest said hammer means, the thickness of said vertical plate providing the distance at which the tack strip is installed from the wall.

13. The apparatus of claim 7, further comprising cutting means on said frame for severing a tack strip.

14. The apparatus of claim 7, further comprising curved claw means on said frame for removing a tack strip from an installed position.

* * * * *